US007278891B2

(12) United States Patent
Cvasa et al.

(10) Patent No.: US 7,278,891 B2
(45) Date of Patent: Oct. 9, 2007

(54) ELECTRICAL CONNECTOR ELEMENT

(75) Inventors: Eduard Cvasa, Bochum (DE); Karl Wirth, Pulheim (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/416,807

(22) Filed: May 3, 2006

(65) Prior Publication Data

US 2006/0252294 A1 Nov. 9, 2006

(30) Foreign Application Priority Data

May 3, 2005 (EP) ..... 05009702

(51) Int. Cl.
*H01R 11/22* (2006.01)

(52) U.S. Cl. ..... 439/852

(58) Field of Classification Search ..... 439/852, 439/843, 857

See application file for complete search history.

(56) References Cited

U.S. PATENT DOCUMENTS 5,685,746 A * 11/1997 Maejima ..... 439/845
5,951,314 A 9/1999 Durand-Cochet et al.
6,042,433 A * 3/2000 Chen ..... 439/852
6,547,608 B2 * 4/2003 Sato et al. ..... 439/852
7,175,487 B2 * 2/2007 Urbaniak et al. ..... 439/852
2001/0051472 A1 * 12/2001 Sato et al. ..... 439/852

FOREIGN PATENT DOCUMENTS

| | | |
|---|---|---|
| DE | 202004006433 | 9/2004 |
| EP | 0926766 | 6/1999 |
| EP | 1202392 | 5/2002 |

* cited by examiner

*Primary Examiner*—Michael C. Zarroli
*Assistant Examiner*—Phuongchi Nguyen
(74) *Attorney, Agent, or Firm*—David P. Wood

(57) ABSTRACT

The invention relates to an electrical connector element comprising a base part having a socket section to receive a plug-in contact and an insertion part inserted into the socket section for the contacting of a plug-in contact introduced into the socket section.

10 Claims, 4 Drawing Sheets

ELECTRICAL CONNECTOR ELEMENT

TECHNICAL FIELD

The invention relates to an electrical connector element comprising a base part having a socket section to receive a plug-in contact and an insertion part inserted into the socket section for the contacting of a plug-in contact introduced into the socket section.

BACKGROUND OF THE INVENTION

A connector element of this kind made in two parts is generally known. Whereas the insertion part inserted into the socket section serves for the contacting of a plug-in contact introduced into the socket section, the base part is typically made such that the connector element can be connected to an electrical line. The electrical path from the line to the plug-in contact therefore leads over the base part and the insertion part. In the known connector element, the insertion part and the base part are welded together to establish an electrical connection. The weld connection can e.g. be made in spot-shape at a plurality of positions by a laser welding process,

SUMMARY OF THE INVENTION

It is the underlying object of the invention to provide an electrical connector element of the initially named kind which withstands an increased current flow and can simultaneously be manufactured with a lower economic effort.

The object is satisfied by an electrical connector element having the features of claim 1.

The connector element in accordance with the invention comprises a base part having a socket section for the reception of a plug-in contract and an insertion part which is inserted into the socket section and which includes two contact spring arms for the contacting of a plug-in contact introduced into the socket section, said contact spring arms merging into one another while forming an insertion part base in an end region of the base part when seen in the plug-in direction, with the insertion part being fixed to the base part by means of a crimp connection in the region of the insertion part base.

The insertion part base itself is not provided for the contacting of a plug-in contact introduced into the socket section. It can therefore be made for an optimum crimp connection independently of the design of the contact spring arms.

The crimp connection does not only provide a secure mechanical connection between the insertion part and the base part, but also an electrical and thermal coupling of the insertion part and the base part improved in comparison with a weld connection. The crimp connection in particular has a reduced electrical resistance and an increased thermal conductivity in comparison with a weld connection. Larger currents can thus flow over the crimp connection without the connector element significantly warming up in the region of the crimp connection. The maximum current which can flow over the connector element in accordance with the invention is consequently substantially higher than with a connector element with a welded insertion part and base part.

The crimp connection can furthermore be established more easily than a weld connection. It is in particular not necessary to invest in a welding apparatus, for example a laser welding apparatus. The crimp connection can instead be produced e.g. by a stamp bending apparatus which is also used to manufacture the insertion part or the base part. The reduced investment costs contribute to allowing the connector element in accordance with the invention to be manufactured with a lower economic effort overall.

Preferred embodiments of the invention can be seen from the dependent claims, from the description and from the drawing.

At least one crimp lug whose free end is supported at the insertion part base in the bent over state can be provided at the base part for the formation of the crimp connection.

The base part preferably has two crimp lugs each bent inwardly by approximately 180° to form the crimp connection. A specific symmetry is achieved by the presence of two crimp lugs which results in a further improvement of the electrical and mechanical properties of the crimp connection. Since the crimp lugs are bent over inwardly, the connector element has a compact design.

At least one bent over crimp lug of the base part advantageously engages into a recess of the insertion base part. A particularly reliable mechanical connection of the base part and the insertion part is thereby achieved. The bent over crimp lug of the base part engaging into the recess of the insertion part base in particular secures the insertion part against a displacement relative to the base part, for example when a plug-in contact is introduced into the socket section. A correct function of the connector element is permanently ensured in this manner. At the same time, the contact surface between the crimp lug and the insertion part is enlarged by the engagement of the crimp lug into the recess and the electrical and thermal coupling of the base part and the insertion part is thus improved even further.

A first material layer of the insertion part base facing the crimp lug preferably has a cut-out to form a recess of the insertion part into which the crimp lug engages. The insertion part base and thus the whole insertion part is secured against a displacement relative to the base part by the engagement of the crimp lug into the cut-out.

It is particularly advantageous for the insertion part base to have spring properties. A crimp lug of the base part cooperating with the insertion part can thus effect a deformation of the insertion part base and can be supported on it against the restoring force of the insertion part base. A sufficient contact force between the crimp lug and the insertion part and thus a reliable electrical and mechanical connection of the insertion part and the base part is thereby permanently ensured.

A second material layer of the insertion part base remote from the crimp lug advantageously includes a bulge facing the direction of the crimp lug. The bulge gives the insertion part base a certain spring property which contributes to a permanently reliable crimp connection.

It is particularly preferred for the bulge of the second material layer to be arranged in the region of a cut-out of a first material layer of the insertion part base. In this manner, the or each crimp lug of the base part engaging into the cut-out can be supported at the bulge of the insertion part. It is ensured by the spring properties of the bulge that the or each crimp lug permanently exerts a sufficient contact force onto the insertion part base. An optimum mechanical, electrical and thermal coupling of base part and insertion part is thus permanently ensured.

A, and preferably each, contact spring arm preferably has at least one longitudinal bulge extending in the plug-in direction. The contact spring arm is stiffened by the longitudinal bulge. In this manner, the stability of the contact spring arm and thus of the insertion part overall is increased, on the one hand, and it is ensured, on the other hand, that a plug-in contact introduced into the socket section can be permanently acted on with sufficient contact force. A longitudinal bulge of a contact spring arm can merge into a bulge of a second material layer of the insertion part base.

A, and preferably each, contact arm preferably has a widened section, in particular of T shape, in the region of its free end. The widened section permits an additional fixing of the insertion part to the base part.

The or each widened section can engage into a cut-out of the base part which is provided for the plug-in contact in the region of an insertion opening of the socket section. The widened section engaging into the cut-out provides an additional locking of the insertion part to the base part, it in particular prevents a displacement of the insertion part relative to the base part in the plug-in direction on the introduction of a plug-in contact. The insertion part is thus not only fixed to the base part in the region of the insertion part base, but furthermore also in the region of the introduction opening, in other words therefore in two regions spaced apart from one another in the plug-in direction. The insertion part is thereby supported even more reliably in the base part.

The insertion part is preferably manufactured by bending over of a substantially U-shaped stamped part. This permits the manufacture of the insertion part with a minimal material effort. The connector element can thereby be produced even more cost favorably overall.

The crimp connection is advantageously provided in a region of the base part disposed behind the socket section in the plug-in direction and is in particular arranged between the socket section and a connection section of the base part for the connection of the connector element to an electrical line. Neither the introduction of a plug-in contact into the socket section nor the connection of the connector element to an electrical line is thus impaired by the crimp connection.

BRIEF DESCRIPTION OF THE DRAWINGS

The invention will be described in the following purely by way of example with reference to an advantageous embodiment and to the drawing. There are shown.

DESCRIPTION OF THE PREFERRED EMBODIMENT

The connector element in accordance with the invention shown in the Figures is an electrical connector element which is made in two parts and includes a base part 10 and an insertion part 12. The base part 10 and the insertion part 12 are each made as stamped bending parts and each comprise an electrically conductive material.

Figure 1:
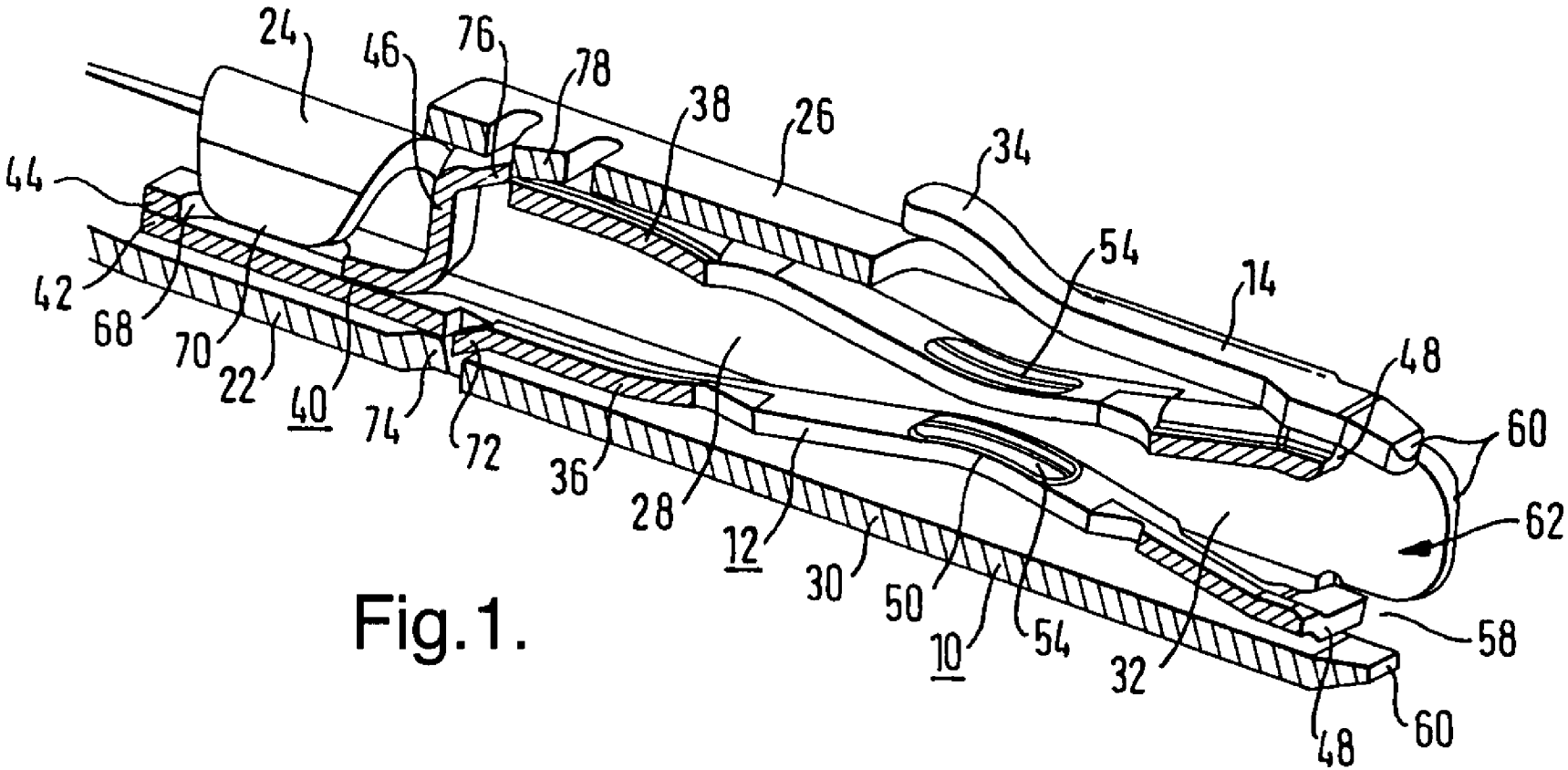
FIG. 1 is a longitudinal section through an electrical connector element in accordance with the invention.
Figure 2B:
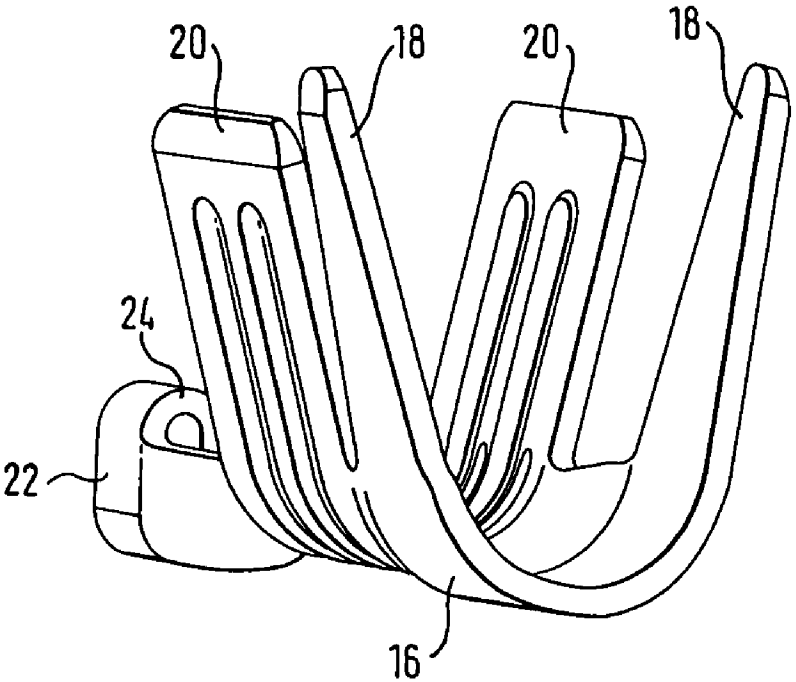
FIG. 2B is a crimp section of the connector element of FIG. 1 for the connection of the same to an electrical line.

As FIGS. 1 and 2 show, the base part 10 includes a socket section 14 for the reception of a plug-in contact (not shown) and a first crimp section 16 with first and second crimp lugs 18, 20 for the electrical and mechanical connection of the connector element to an electrical line (not shown).

In the transition from the socket section 14 to the first crimp section 16, a second crimp section 22 with third crimp lugs 24 is provided which serve for the fixing of the insertion part 12 to the socket section 14, as will be explained in more detail in the following.

Figure 2A:
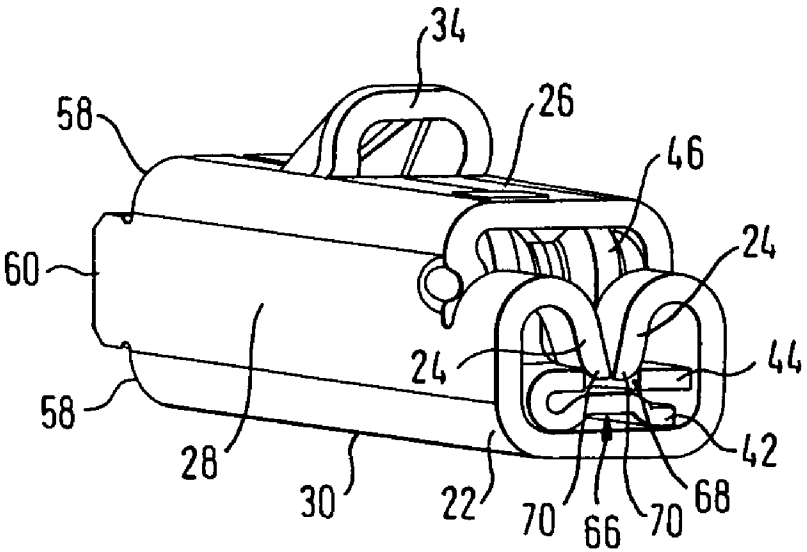
FIG. 2A is a cross-section through the connector element of FIG. 1 in the region of crimp lugs for the fixing of an insertion part to a base part of the connector element.

As FIG. 2A shows, the socket section 14 has a substantially parallelepiped basic shape with an approximately square cross-section in the embodiment shown. The socket section 14 includes four side walls 26, 28, 30 which bound a reception space 32 for the plug-in contact and the insertion part 12. A latch projection 34, which permits a latching of the connector element in a connector element housing, is formed at an upper side wall 26.

Figure 3:
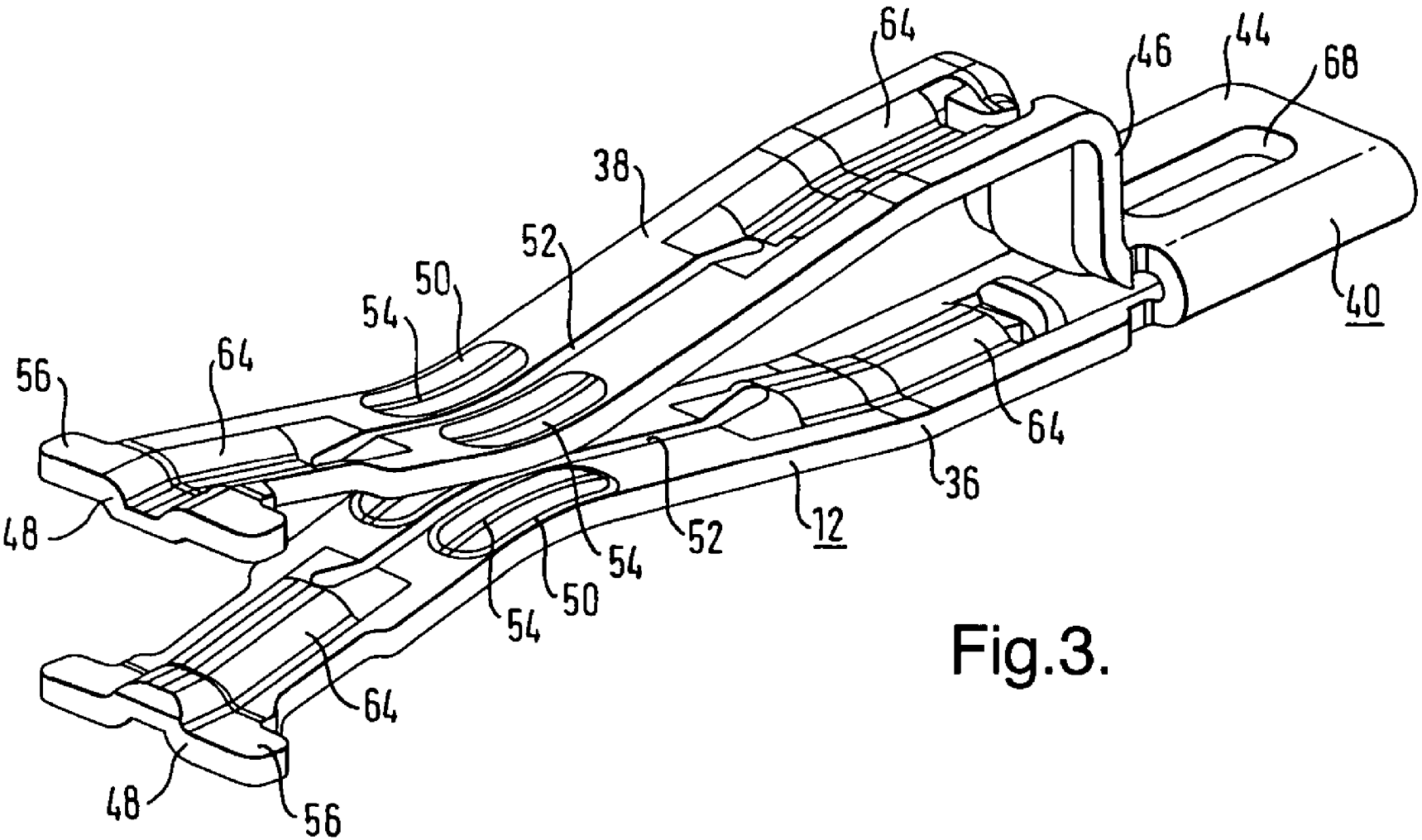
FIG. 3 is a perspective view of the insertion part.
Figure 4:
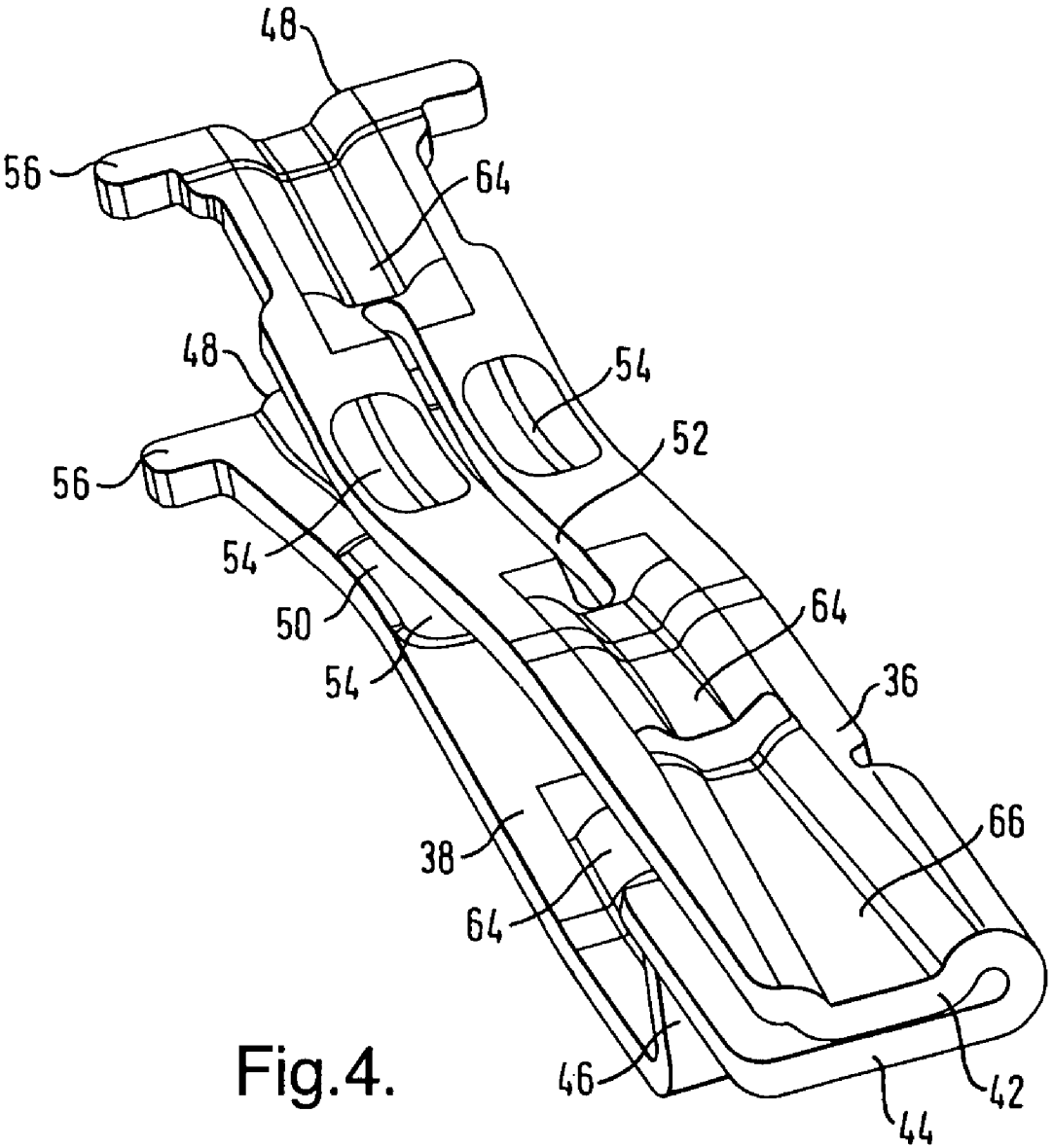
FIG. 4 is a further perspective view of the insertion part.

As is shown in FIGS. 3 and 4, the insertion part 12 has two contact spring arms 36, 38 which are connected to one another via an insertion part base 40. The insertion part base 40 includes two material layers 42, 44 which are formed by the bending over of the base section of a sheet metal plate stamped out in U shape. The one contact spring arm 36 originates directly from the one material layer 42, whereas the other contact spring arm 38 is connected to the other material layer 44 via a transition section 46 which is oriented substantially perpendicular to the contact spring arms 36, 38 and to the insertion part base 40.

Starting from the insertion part base 40, the contact spring arms 36, 38 converge toward one another in the direction of their free ends 48. In a contact region 50 provided for the electrical and mechanical contacting of a plug-in contact introduced into the socket section 14, the contact spring arms 36, 38 have a minimal spacing from one another.

In the region of the contact region 50, the contact spring arms 36, 38 are each provided with an elongate gap 52 extending in the plug-in direction, which has the result that a plug-in contact introduced into the socket section 14 is contacted by the contact spring arms 36, 38 in four different regions 54 overall and the reliability of the contact is thereby increased.

Starting from the contact region 50, the contact spring arms 36, 38 diverge again in the direction of their free ends 48 to facilitate the introduction of a plug-in contact and to reduce the risk of damage to the insertion part 12 on the introduction of the plug-in contact.

In the region of their free ends 48, the contact spring arms 36, 38 each have a T-shaped widened section 56. The T-shaped widened sections 56 engage into cut-outs 58 of the socket section 40 which are bounded by tongue-like prolongations 60 which project from the side walls 26, 28, 30 of the socket section 14 in the region of an introduction opening 62. The T-shaped widened sections 56 engaging into the cut-outs 58 prevent the insertion part 12 from being displaced in the plug-in direction relative to the base part 10 on the insertion of a plug-in contact into the socket section 14.

Both in a region disposed between the contact region 50 and the free ends 48 and in a region disposed between the contact region 50 and the insertion part base 40, the contact spring arms 36, 38 have longitudinal bulges 64 which extend in the plug-in direction and increase the stiffness of the contact spring arms 36, 38 and thus the stability of the insertion part 12. The longitudinal bulge 64 of the lower contact spring arm 36 at the rear when considered in the plug-in direction merges into a bulge 66 which is provided in the lower material layer 42 of the insertion part base 40.

The bulge 66 gives the lower material layer 42, and thus the insertion part base 40 overall, a certain resilient property in a direction perpendicular to the main plane of the insertion part base 40. An elongate cut-out 68 is provided in the upper material layer 44 and forms a recess of the insertion part base 40.

The length of the contact spring arms 36, 38 substantially corresponds to the length of the socket section 14 such that the insertion part base 40 projects out of the socket section 14 and into the second crimp section 22.

The third crimp lugs 24, which project from prolongations of the side walls 28 of the socket section 14, are inwardly bent over by approximately 180° and are supported at the insertion part base 40. In more precise terms, the free ends 70 of the third crimp lugs 24 project at least partly into the cut-out 68 of the upper material layer 44 of the insertion part base 40. The third crimp lugs 24 are slightly chamfered in the region of their free ends 70 to be able to slide more easily past the edge of the upper material layer 44 bounding the cut-out 68 or to be able to support themselves on it.

The support force exerted onto the insertion part base 40 by the third crimp lugs 24 is transmitted directly via the crimp lugs 24 and/or indirectly via the upper material layer 44 onto the bulge 66 of the lower material layer 42. A sufficient contact force, i.e. a reliable contacting of the third crimp lugs 24 with the insertion part base 40, is permanently ensured by the spring property of the bulge 66 of the lower material layer 42.

Not only a particularly low-ohm electrical connection of the base part 10 and the insertion part 12 is thus achieved by the cooperation of the third crimp lugs 24 with the insertion part base 40, but the insertion part 12 is also additionally fixed to the base part 10 by the third crimp lugs 24 engaging into the cut-out 68 of the insertion part base 40. The risk of a displacement of the insertion part 12 relative to the base part 10 on the introduction of a plug-in contact into or out of the socket section 14 is thereby reduced even further.

To hold the insertion part 12 even more reliably at the base part 10, the lower contact arm 36 in the Figures has a latch projection 72 which cooperates with a corresponding latch tongue 74 of the lower side wall 30 of the socket section 14 and the upper contact spring arm 38 has a latch projection 76 which cooperates with a latch tongue 78 of the upper side wall 26 of the socket section 14. The latch projections 72, 76 are oppositely oriented, i.e. the upper latch projection 72 rises in the direction of the introduction opening 62 of the socket section 14 and the lower latch projection 76 rises in the direction of the insertion part base 40. In this manner, the insertion part 12 is also secured by the latch projections 72, 76 against a displacement both in and opposite to the plug-in direction relative to the base part 10.

The invention claimed is:

1. An electrical connector element comprising a base part having a socket section for the reception of a plug-in contact and an insertion part which is inserted into the socket section and includes two contact spring arms for the contacting of plug-in contact introduced into the socket section, said contact spring arms converging toward a contact region wherein the contact spring arms have a minimal spacing from one another and diverging toward their free ends to facilitate the introduction of the plug-in contact, said contact spring arms connected to one another via an insertion part base that includes two materials layers formed by bending a sheet metal plate into a U-shape in an end region of the insertion part at the rear when considered in the plug-in direction, with the insertion part being fixed to the base part in the region of the insertion part base by means of a crimp connection.

2. A connector element in accordance with claim 1, wherein the insertion part base has spring properties.

3. A connector element in accordance with claim 1, wherein a, and preferably each, contact spring arm has at least one longitudinal bulge extending in the plug-in direction.

4. A connector element in accordance with claim 1, wherein the insertion part is manufactured by bending over of a substantially U-shaped stamped part.

5. A connector element in accordance with claim 1, wherein at least one bent over crimp lug of the base part engages into a recess of the insert part base.

6. A connector element in accordance with claim 5, wherein a first material layer of the insertion part base facing the crimp lug has a cut-out to form the recess.

7. A connector element in accordance with claim 1, wherein a second material layer of the insertion part base remote from a crimp lug cooperating with the insertion part base includes a bulge facing in the direction of the crimp lug.

8. A connector element in accordance with claim 7, wherein the bulge of the second material layer is arranged in the region of a cut-out of a first material layer of the insertion part base.

9. A connector element in accordance with claim 1, wherein a, and preferably each, contact arm has a widened section, in particular of T shape, in the region of its free end.

10. A connector element in accordance with claim 9, wherein the or each widened section engages into a cut-out of the base part which is provided for the plug-in contact in the region of an insertion opening of the socket section.

* * * * *